US012741790B1

(12) United States Patent
Song et al.

(10) Patent No.: US 12,741,790 B1
(45) Date of Patent: Sep. 22, 2026

(54) FLEXIBLE CONTAINER

(71) Applicant: Dongguan ChiJian Electronic Technology CO., LTD, Guangdong (CN)

(72) Inventors: Xingxing Song, Guangdong (CN); Guanglei Kan, Guangdong (CN)

(73) Assignee: Dongguan ChiJian Electronic Technology CO., LTD, Guangdong (CN)

( * ) Notice: Subject to any disclaimer, the term of this patent is extended or adjusted under 35 U.S.C. 154(b) by 0 days.

(21) Appl. No.: 19/269,997

(22) Filed: Jul. 15, 2025

(51) Int. Cl.
*B65D 43/02* (2006.01)
*B65D 37/00* (2006.01)
*B65D 41/08* (2006.01)

(52) U.S. Cl.
CPC ..... *B65D 43/0231* (2013.01); *B65D 37/00* (2013.01); *B65D 41/08* (2013.01); *B65D 41/086* (2013.01); *B65D 2251/0062* (2013.01)

(58) Field of Classification Search
CPC ..... B65D 43/0231; B65D 37/00; B65D 2251/0062; B65D 41/08; B65D 41/086
USPC ..... 215/335
See application file for complete search history.

(56) References Cited

U.S. PATENT DOCUMENTS

| | | | | |
|---|---|---|---|---|
| 5,174,460 | A * | 12/1992 | Minnette | B65D 41/086 215/335 |
| 5,860,556 | A * | 1/1999 | Robbins, III | B65D 1/0292 220/666 |
| 9,221,582 | B2 * | 12/2015 | Wheeler | B65D 21/086 |
| 10,364,072 | B2 * | 7/2019 | Tebbe | B65D 23/104 |
| 11,596,250 | B2 * | 3/2023 | Fadden | A47G 19/2205 |
| 2015/0297032 | A1 * | 10/2015 | Abrams | B65D 21/086 220/592.16 |

* cited by examiner

*Primary Examiner* — Nathan J Jenness
*Assistant Examiner* — Jennifer Castriotta
(74) *Attorney, Agent, or Firm* — Hawaii Patent Services; Nathaniel K. Fedde; Kenton N. Fedde

(57) ABSTRACT

A flexible container, having a shell assembly, a cover assembly, and a connection mechanism; the shell assembly forms a detachable connection with the cover assembly through the connection mechanism; the shell assembly has a flexible shell with an opening; the flexible shell is provided with a limiting step; the connection mechanism has a connecting ring and a compression ring; the compression ring has a limiting member, wherein the limiting step and the limiting member are used in conjunction to secure the connecting ring to the flexible shell.

13 Claims, 7 Drawing Sheets

FLEXIBLE CONTAINER

TECHNICAL FIELD

The present disclosure relates to the technical field of containers, particularly to a flexible container.

BACKGROUND

A silicone children's snack cup is a silicone container specially designed for children, mainly used for storing and feeding snacks, which features safety, practicality, and fun.

In the prior art, silicone containers mainly use welding or chemical bonding processes to fix the cup body and the threaded connection part. This traditional process has the following technical defects:

1. During welding, high-precision molds are required to achieve the bonding between silicone and rigid connectors, resulting in high costs for mold design and maintenance; whereas chemical bonding processes necessitate secondary curing procedures, prolonging production cycles and reducing manufacturing efficiency.
2. When threads are assembled via welding, microscopic grooves are formed at the welded seams, creating cleaning blind spots that harbor bacteria and compromise children's health; when threads are assembled via adhesive bonding, residual adhesive may remain and release volatile organic compounds, which also affects children's health.

Therefore, there is a need to propose a novel container with low processing costs, where the cover and mounting structure can be disassembled for easy cleaning, eliminating any hard-to-clean areas.

SUMMARY

The present disclosure provides a flexible container to address the issues raised in the background.

To achieve the above object, the present disclosure adopts the following technical solutions:

A flexible container comprises a shell assembly, a cover assembly, and a connection mechanism. The shell assembly is detachably connected to the cover assembly through the connection mechanism and the shell assembly comprises a flexible shell with an opening; and the flexible shell is provided with a limiting step; and the connection mechanism comprises a connecting ring and a compression ring; and the compression ring comprises a limiting member. The limiting step and the limiting member are used in conjunction to secure the connecting ring to the flexible shell.

The present disclosure further provides a flexible container, comprising a shell assembly, a cover assembly, and a connection mechanism. The shell assembly is detachably connected to the cover assembly through the connection mechanism and the shell assembly comprises a flexible shell with an opening; and the flexible shell is provided with a limiting step; and the connection mechanism comprises a connecting ring and a compression ring; and the compression ring comprises a limiting flange. The limiting step and the limiting flange are used in conjunction to secure the connecting ring to the flexible shell.

The present disclosure further provides a flexible container, comprising a shell assembly, a cover assembly, and a connection mechanism. The shell assembly is detachably connected to the cover assembly through the connection mechanism; and the shell assembly comprises a flexible shell with an opening; and the connection mechanism comprises a connecting ring and a compression ring; and the connecting ring is arranged on the opening of the flexible shell and provided with a first connecting part; and the compression ring comprises an insertion part and a limiting flange, the insertion part forms an interference fit with the opening of the flexible shell, and the limiting flange extends outward from the insertion part. The cover assembly is provided with a second connecting part, the second connecting part is detachably connected to the first connecting part, and the limiting flange presses against a top of the connecting ring.

With the fully detachable design of the flexible shell and the cover assembly, as well as the separable structure of the connecting ring and the compression ring, each component can be cleaned independently, avoiding sanitary dead corners, effectively preventing bacterial growth, and ensuring children's health.

BRIEF DESCRIPTION OF DRAWINGS

The drawings, which constitute a part of this application, are provided to further illustrate the present disclosure. The schematic embodiments and descriptions of the present disclosure are intended to explain the present disclosure and do not constitute any improper limitation. In the drawings.

REFERENCE SIGNS

Figure 1:
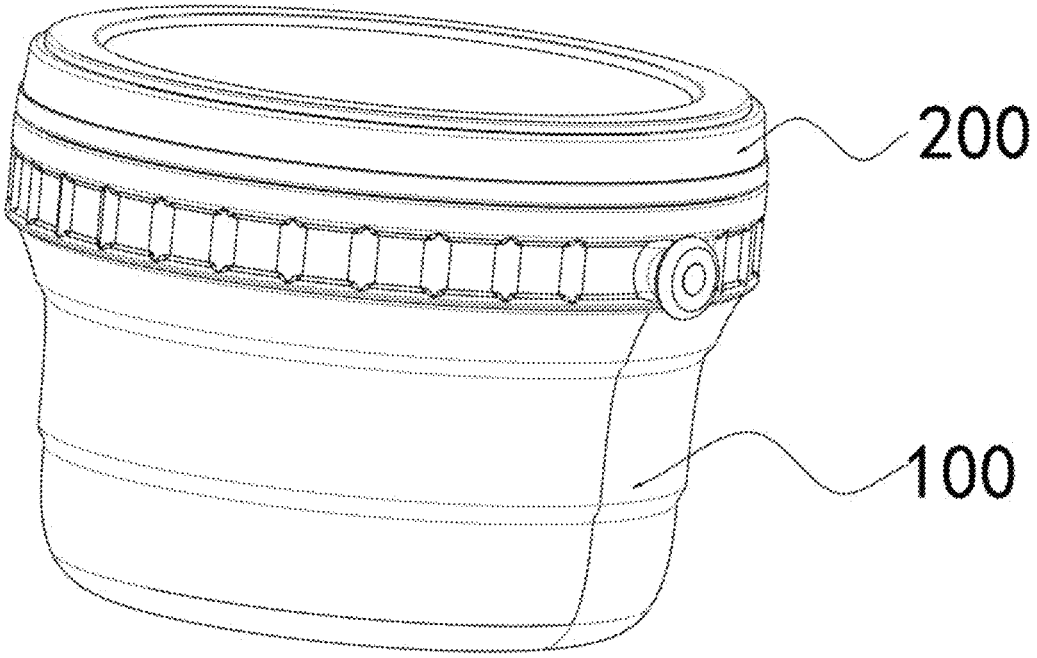
FIG. 1 is a schematic structural diagram of an embodiment implementing the present disclosure.
Figure 2:
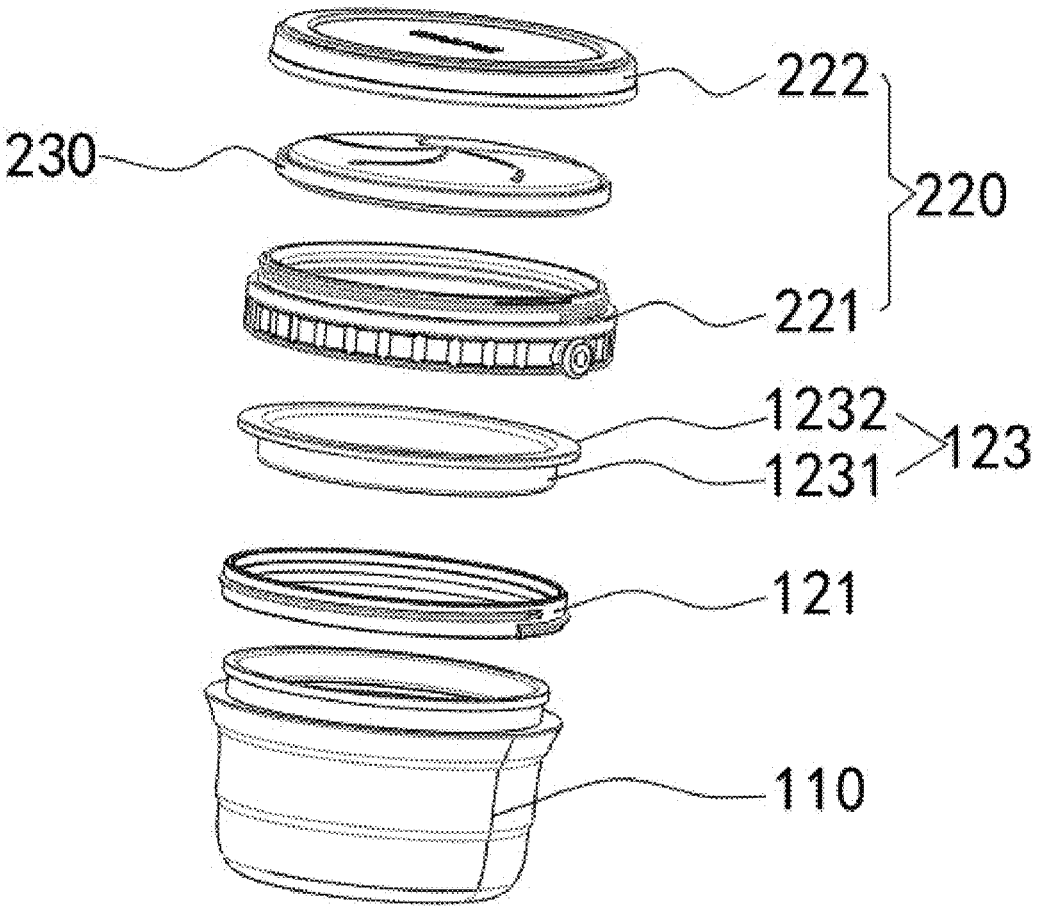
FIG. 2 is an exploded schematic structural diagram of FIG. 1.

Shell assembly (100); Flexible shell (110); Annular groove (111); Limiting step (1111); Connection mechanism (120); Connecting ring (121); First connecting part (122); Compression ring (123); Insertion part (1231); limiting flange (1232); Cover assembly (200); Second connecting part (210); Cover (220); Annular cover (221); extension part (2211); sealing cover (222); elastic retaining ring (230); flexible baffle (231).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 8, a flexible container includes a shell assembly 100 and a cover assembly 200 detachably mounted on the shell assembly 100. The shell assembly 100 includes a flexible shell 110 with an opening and a connection mechanism 120 detachably installed on the flexible shell 110. The flexible shell 110 is provided with a limiting step 1111, and the connection mechanism 120 is used to detachably connect the flexible shell 110 with the cover assembly 200. The connection mechanism 120 includes a connecting ring 121 and a compression ring 123, with the compression ring 123 including a limiting flange 1232. The limiting step 1111 and the limiting flange 1232 are used in conjunction to secure the connecting ring 121 to the flexible shell 110.

In other embodiments, the connection mechanism 120 includes a first connecting part 122. The cover assembly 200 is provided with a second connecting part 210, and the first connecting part 122 and the second connecting part 210 are detachably connected, enabling the flexible shell 110 and the cover assembly 200 to form a detachable connection, which facilitates the separation of the flexible shell 110 from the cover assembly 200. The fully detachable design of the flexible shell 110 and the cover assembly 200 supports independent cleaning, avoiding hygiene dead spots. The separable structure of the connecting ring 121 and the compression ring 123 further enhances cleaning convenience, allowing users to thoroughly clean the product without any dead spots.

In other embodiments, the connecting ring 121 is sleeved outside the opening of the flexible shell 110. The compression ring 123 further includes an insertion part 1231, which is located inside the opening of the flexible shell 110, while the limiting flange 1232 is partially positioned outside the opening. In this case, the first connecting part 122 is arranged on the connecting ring 121, and the limiting flange 1232 presses against the top of the connecting ring 121.

In other embodiments, the connecting ring 121 is located inside the opening of the flexible shell 110. The compression ring 123 further includes an insertion part 1231, which is positioned outside the opening of the flexible shell 110, while the limiting flange 1232 is partially located inside the opening. Here, the first connecting part 122 is arranged on the connecting ring 121, and the limiting flange 1232 presses against the top of the connecting ring 121.

In other embodiments, the flexible shell 110 may be made of elastic flexible materials such as silicone or rubber. Elastic materials like silicone and rubber can effectively cushion impacts, preventing the container from breaking when dropped and avoiding injury to children by fragments. Additionally, food-grade silicone and rubber are typically non-toxic and odorless, making them suitable for children's use.

As shown in FIGS. 4, 5, 7, and 8, in this embodiment, the first connecting part 122 and the second connecting part 210 are an external thread and an internal thread respectively arranged on the flexible shell 110 and the cover assembly 200. The threaded engagement structure forms a rigid mechanical lock, providing uniform circumferential pressure through thread meshing to ensure a secure connection between the cover assembly 200 and the shell assembly 100. This design effectively resists accidental opening caused by external vibrations or children's mishandling, reducing the risk of content leakage. Meanwhile, the threaded connection can be disassembled without complex tools, facilitating thorough cleaning of the interior of the flexible shell 110 by parents to prevent bacterial growth from food residues. The standardized thread design reduces assembly difficulty and enhances user experience.

In other embodiments (not shown), the cover assembly 200 and the flexible shell 110 may not be connected via threaded engagement but can alternatively adopt snap-fit or magnetic connections. For the snap-fit method, protruding sticking points can be arranged on the outer surface of the connecting ring 121, corresponding to L-shaped guide grooves designed on the inner wall of the cover assembly 200. Locking between the sticking points and the groove paths is achieved through a short rotational stroke of 15°-30°. Compared to traditional threaded connections, this structure features a shorter rotation stroke and simpler operation, making it particularly suitable for scenarios requiring frequent opening and closing by children. For magnetic connections, annular neodymium magnet arrays can be embedded on the surface of the connecting ring 121, with magnetic conductive sheets placed at corresponding positions inside the cover assembly 200. The magnetic attraction automatically corrects positional deviations during connection, thereby reducing assembly difficulty.

Figure 3:
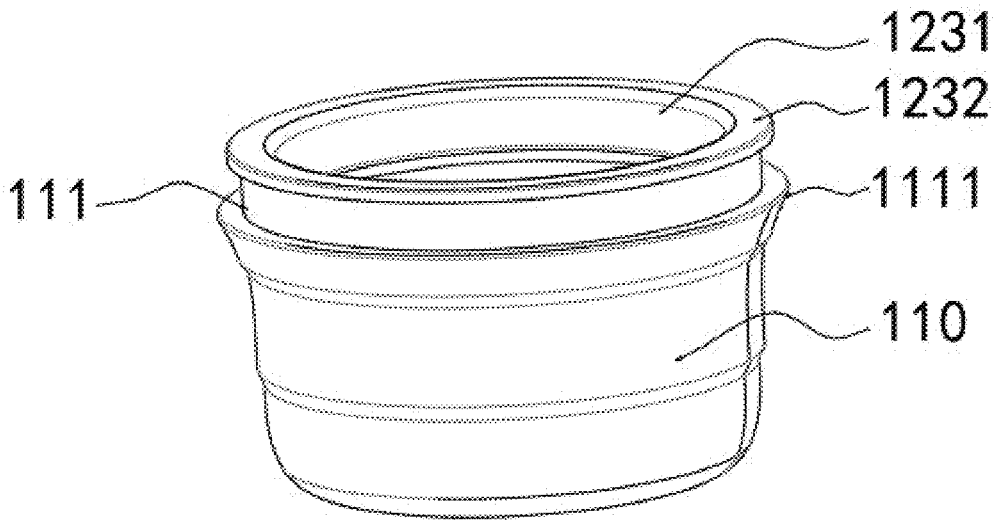
FIG. 3 is a schematic structural diagram of the flexible shell and compression ring in FIG. 1.

As shown in FIGS. 1 and 3, in this embodiment, the outer surface of the flexible shell 110 is provided with an annular groove 111, and the connecting ring 121 is sleeved within the annular groove 111. The depth of the annular groove 111 matches the thickness of the connecting ring 121, allowing the flexible shell 110 to undergo controlled elastic deformation under a pressure. This ensures the sealing pressure when the connecting ring 121 is thread-locked with the cover assembly 200 while avoiding material fatigue caused by excessive compression.

In other embodiments (not shown), the annular groove 111 is provided with a clamping groove, and the inner surface of the connecting ring 121 is equipped with a protrusion that is embedded into the clamping groove to form a snap-fit. The clamping groove provides a directional embedding path for the protrusion, ensuring quick and precise alignment between the connecting ring 121 and the flexible shell 110, reducing assembly deviations, and improving production efficiency and assembly consistency.

In other embodiments (not shown), the inner wall of the connecting ring 121 is embedded with an annular magnet array, while the annular groove 111 of the flexible shell 110 is correspondingly equipped with a magnetic-conductive metal ring. A fixing groove is provided within the annular groove 111. When the connecting ring 121 approaches the flexible shell 110, magnetic attraction guides the protrusion to automatically align with the fixing groove. The compression ring 123 is made of a non-magnetic material to avoid interfering with magnetic positioning. This magnetic fixation method effectively prevents accidental disassembly by children while facilitating quick one-handed assembly for parents.

Figure 4:
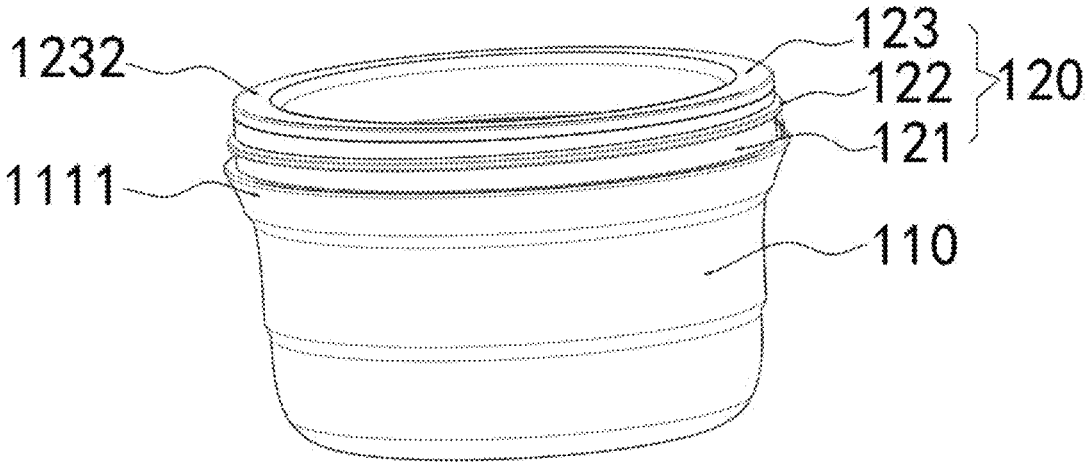
FIG. 4 is a schematic structural diagram of the flexible shell, compression ring, and connecting ring in FIG. 1.
Figure 7:
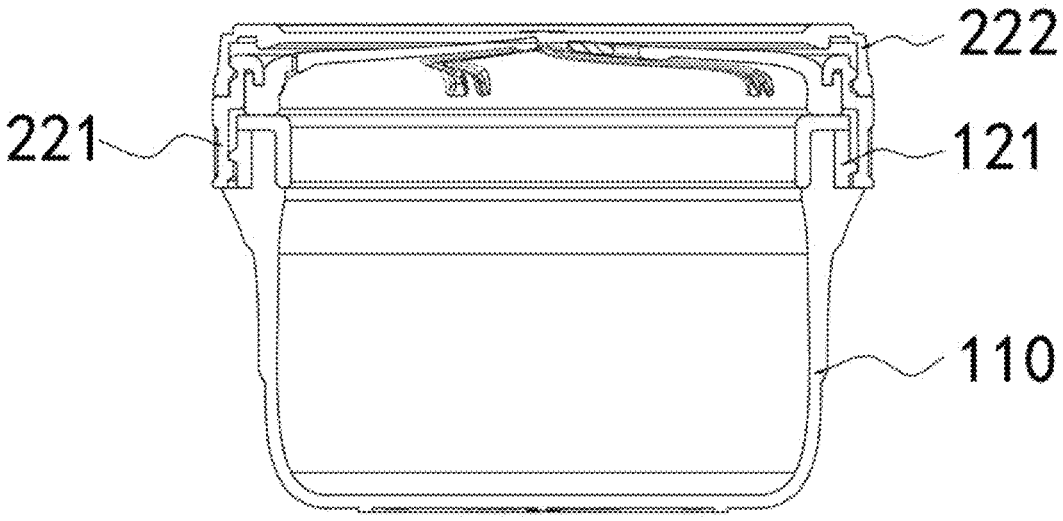
FIG. 7 is a front cross-sectional view of FIG. 1.
Figure 8:
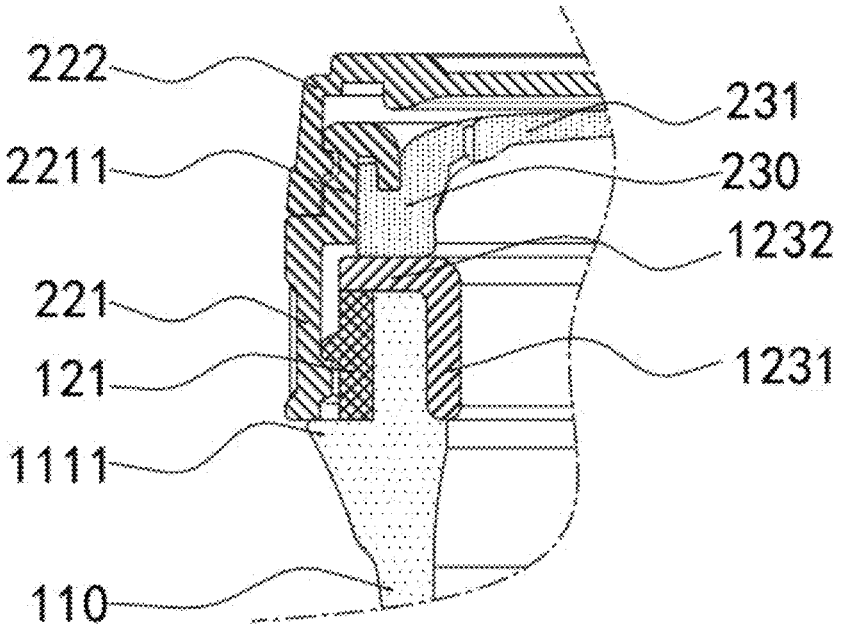
FIG. 8 is a partial enlarged view of FIG. 7.
Figure 9:
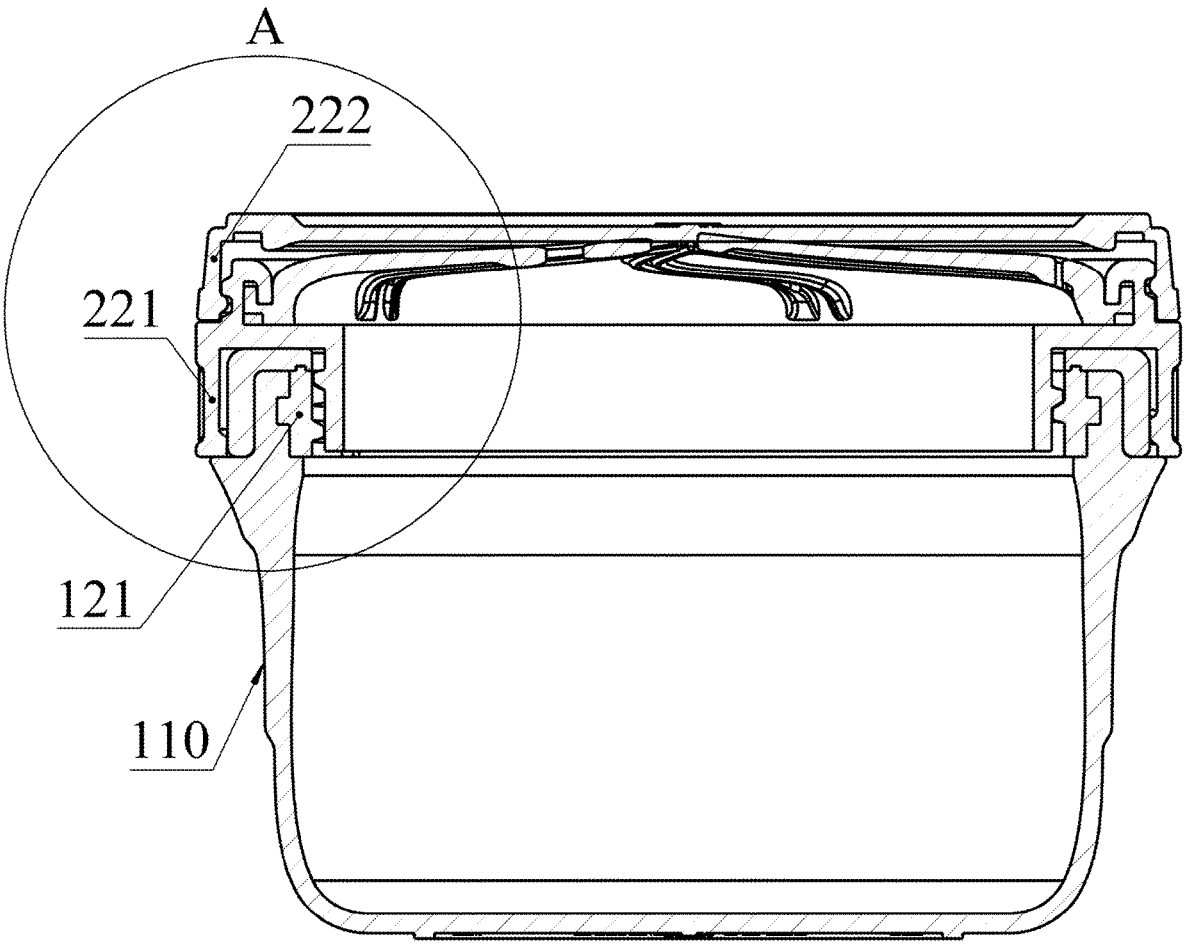
FIG. 9 is a front cross-sectional view of another embodiment.
Figure 10:
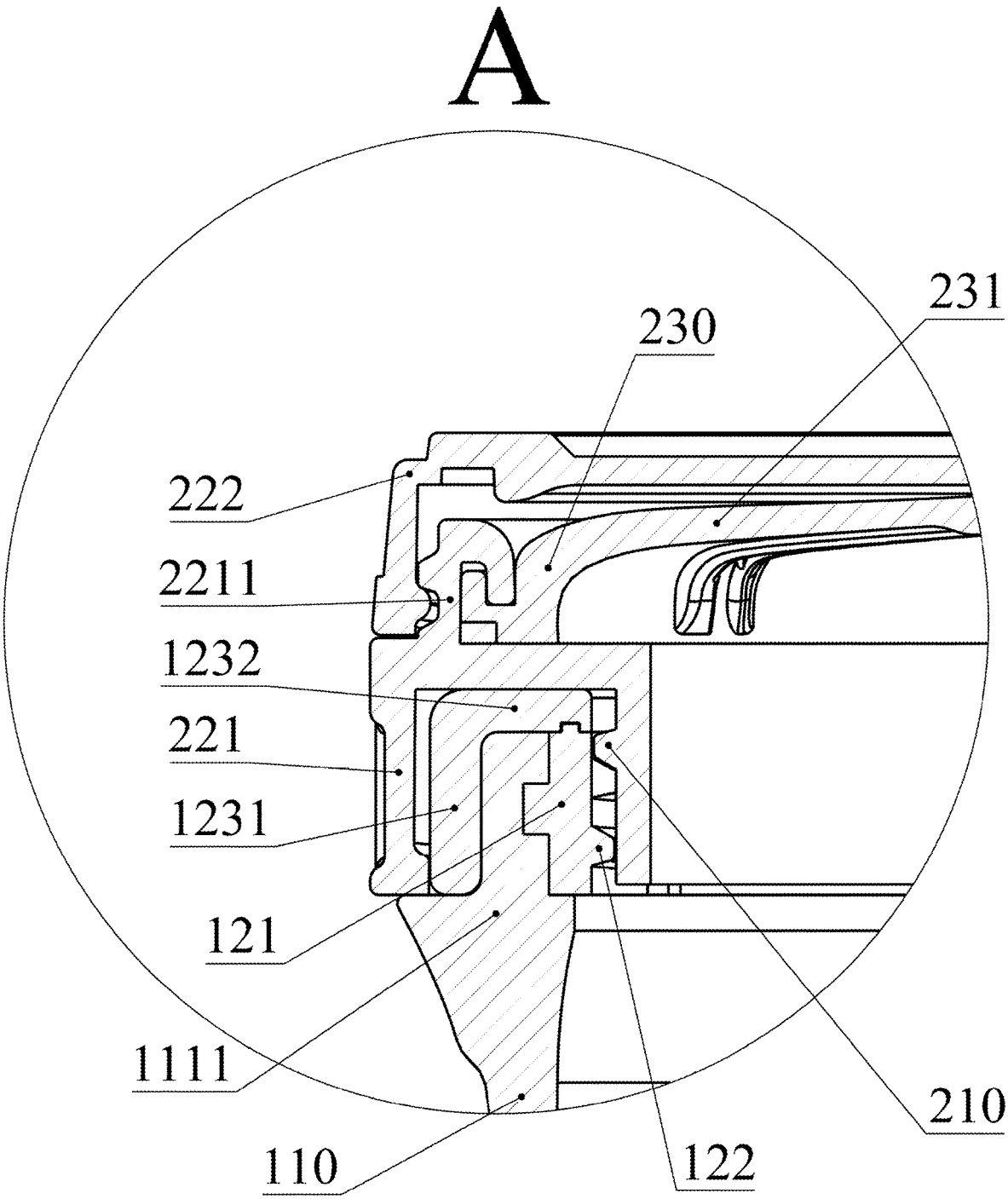
FIG. 10 is a partial enlarged view of FIG. 9.

Referring to FIGS. 4, 7, and 8, in other embodiments, the limiting step 1111 may be arranged at the bottom of the annular groove 111 to restrict downward movement of the connecting ring 121, while the limiting flange 1232 of the compression ring 123 presses against the top of the connecting ring 121. The limiting step 1111 physically blocks downward movement of the connecting ring 121, and the limiting flange 1232 of the compression ring 123 constrains upward displacement, forming a bidirectional fixation. This dual restraint effectively prevents axial displacement of the connecting ring 121 due to external forces or container deformation, ensuring stable assembly between the connecting ring 121 and the flexible shell 110.

Referring to FIGS. 1, 2, 5, 7, and 8, in this embodiment, the cover assembly 200 includes a cover 220 covering the exteriors of the connecting ring 121 and compression ring 123, as well as an elastic retaining ring 230 detachably installed inside the cover 220. The elastic retaining ring 230 is compressed and pressed above the compression ring 123, enhancing the overall structural stability and preventing loosening of components. The cover 220 includes an annular cover 221 and a sealing cover 222. The annular cover 221 surrounds the outer side of the connecting ring 121, and the second connecting part 210 is arranged on the inner surface of the annular cover 221 and is detachably connected with the first connecting part 122.

In other embodiments, the sealing cover 222 in the cover assembly 200 is made of transparent material for easy internal inspection. Additionally, the outer surface of the sealing cover 222 features anti-slip textures to improve grip comfort and operational convenience.

Figure 6:
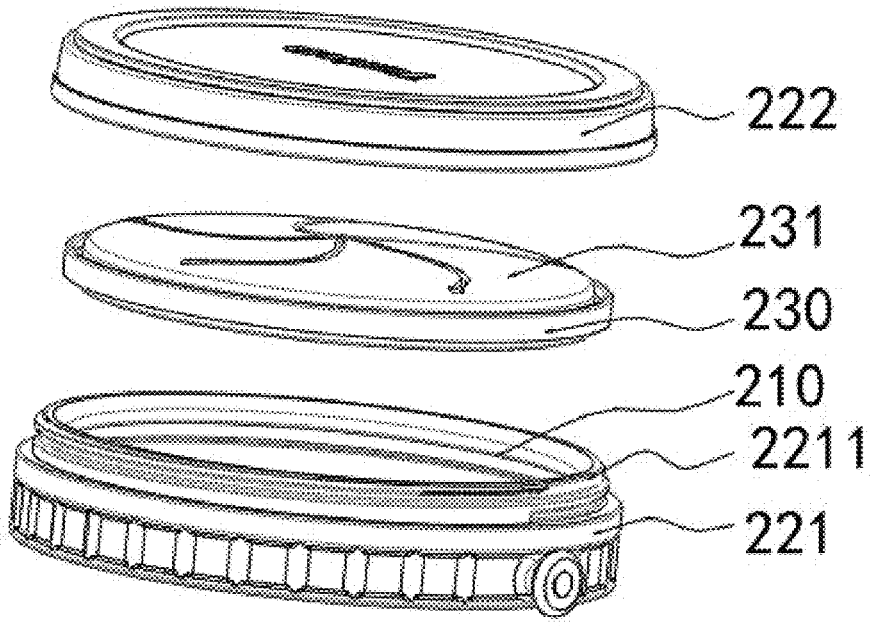
FIG. 6 is an exploded schematic structural diagram of FIG. 5.

Referring to FIGS. 6 and 8, in this embodiment, the annular cover 221 is provided with an extension part 2211 that extends upward beyond the flexible shell 110 and compression ring 123. The elastic retaining ring 230 is detachably installed on the inner side of the extension part 2211 and is compressed and pressed above the compression ring 123. The elastic retaining ring 230 is fixed inside the cover 220 via threaded connection, facilitating later cleaning and replacement by users.

In other embodiments (not shown), the elastic retaining ring 230 is also made of flexible elastic materials such as silicone or rubber. When the annular cover 221 is placed over the flexible shell 110, the elastic retaining ring 230 is compressed and undergoes elastic deformation, thereby pressing the compression ring 123 tightly to prevent loosening.

In other embodiments (not shown), the inner side of the extension part 2211 is additionally embedded with a sealing ring, which presses against the top of the compression ring 123 and is located outside the elastic retaining ring 230. The sealing ring and the elastic retaining ring 230 work together to form a dual-sealing structure, effectively preventing liquid leakage. At the same time, the sealing ring, positioned outside the elastic retaining ring 230, assists in securing the elastic retaining ring 230, thereby preventing the elastic retaining ring 230 from loosening or detaching.

Figure 5:
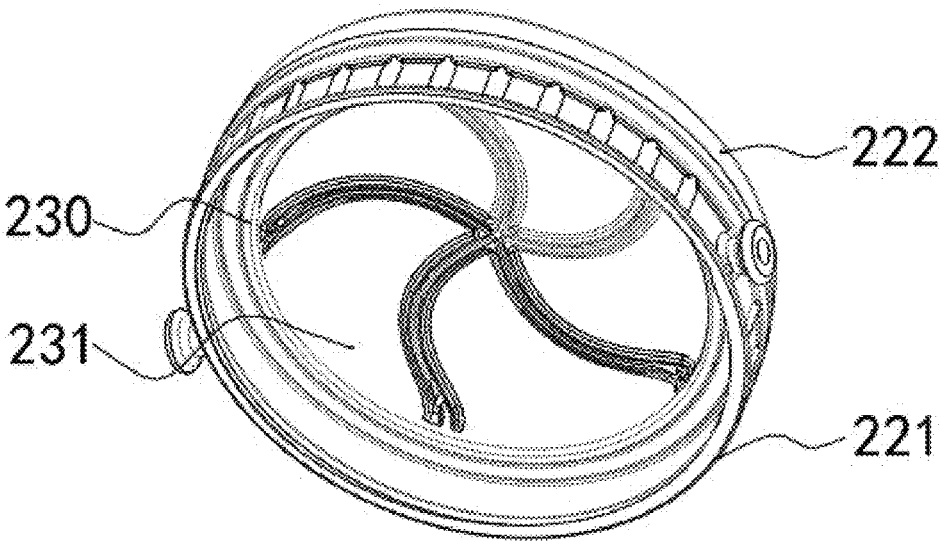
FIG. 5 is a schematic structural diagram of the cover assembly in FIG. 1.

Referring to FIGS. 5, 7, and 8, in this embodiment, the sealing cover 222 is detachably installed on the exterior of the extension part 2211 and seals the top of the annular cover 221. This detachable design allows users to separate the sealing cover 222 from the annular cover 221 at any time, facilitating thorough cleaning of hard-to-reach areas.

In other embodiments (not shown), the inner top of the annular cover 221 is machined with internal threads, while the outer bottom of the sealing cover 222 is machined with matching external threads. During installation, the bottom of the sealing cover 222 is aligned with the top of the annular cover 221, ensuring the thread starting positions match, and then the sealing cover 222 is rotated to connect it with the annular cover 221. Additionally, the connection method between the annular cover 221 and the sealing cover 222 is not limited to threaded connections, and snap-fit connections may also be used. Specifically, snaps and corresponding slots are provided on the contact surfaces of the annular cover 221 and the sealing cover 222, enabling quick connection and separation by pressing or rotating to engage the snaps with the slots.

Referring to FIGS. 1 and 3, in this embodiment, the inner side of the elastic retaining ring 230 is uniformly equipped with a plurality of flexible baffles 231, which are designed to prevent items from escaping the flexible shell 110. The evenly distributed flexible baffles 231 form a plurality of layers of protection, effectively preventing items from detaching from the flexible shell 110.

In other embodiments, the flexible baffles 231 are designed with varying lengths and thicknesses to accommodate items of different shapes and sizes. Longer flexible baffles 231 provide greater coverage, while thicker flexible baffles 231 offer stronger support.

In other embodiments (not shown), the ends of the flexible baffles 231 are equipped with small protrusions or anti-slip patterns to increase friction with items, further preventing them from sliding or falling out.

In other embodiments, the shell assembly 100 and the cover assembly 200 are not limited to use in children's cups but can also be applied to other containers requiring sealing and convenient operation, such as adult water bottles, travel mugs, storage jars, etc.

In other embodiments (not shown), a handle can be installed on the cover assembly 200 to facilitate gripping and carrying.

In other embodiments (not shown), a lifting handle can be installed on the annular cover 221 to facilitate gripping and carrying.

In summary, as can be seen from the above description, the present disclosure achieves the following technical effects:

With the fully detachable design of the flexible shell 110 and the cover assembly 200, as well as the separable structure of the connecting ring 121 and the compression ring 123, each component can be cleaned independently, avoiding hygiene blind spots and effectively preventing bacterial growth, thereby safeguarding children's health. Additionally, the sealing structure formed by the elastic retaining ring 230 can effectively prevent liquid leakage, ensuring safe use. The plurality of flexible baffles 231 arranged on the inner side of the elastic retaining ring 230 provide multi-layered protection, effectively preventing items from falling out of the flexible shell 110 and avoiding accidental ingestion by children or loss of items.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A flexible container, comprising a shell assembly, a cover assembly, and a connection mechanism, wherein the shell assembly forms a detachable connection with the cover assembly through the connection mechanism; and the shell assembly comprises a flexible shell with an opening; and the flexible shell is provided with a limiting step; and the connection mechanism comprises a connecting ring and a compression ring; and the compression ring comprises a limiting member; and wherein the limiting step and the limiting member are configured to be used in conjunction to secure the connecting ring to the flexible shell;

the connecting ring is sleeved outside the opening of the flexible shell;

the compression ring further comprises an insertion part;

the insertion part is located inside the opening of the flexible shell, and the limiting member is partially located outside the opening; and an outer surface of the flexible shell is provided with an annular groove, and the connecting ring is sleeved within the annular groove.

2. The flexible container according to claim 1, wherein the connecting ring is provided with a first connecting part; and the cover assembly is provided with a second connecting part, the second connecting part is detachably connected to the first connecting part, and the limiting member presses against a top of the connecting ring.

3. The flexible container according to claim 2, wherein the first connecting part and the second connecting part are respectively an external thread and an internal thread provided on the flexible shell and the cover assembly.

4. The flexible container according to claim 3, wherein the cover assembly comprises an annular cover, a sealing cover, and an elastic retaining ring, wherein the annular cover surrounds an exterior of the flexible shell, and the second connecting part is arranged on an inner surface of the annular cover and is separably connected with the first connecting part.

5. The flexible container according to claim 4, wherein the annular cover is provided with an extension part extending upward beyond the flexible shell and the compression ring, and the elastic retaining ring is detachably installed on an inner side of the extension part and is compressed to press against the compression ring.

6. The flexible container according to claim 5, wherein the sealing cover is detachably installed on an exterior of the extension part and seals a top of the annular cover.

7. The flexible container according to claim 4, wherein an inner side of the elastic retaining ring is uniformly provided with a plurality of flexible baffles to prevent items from escaping from the flexible shell.

8. The flexible container according to claim 1, wherein the limiting member is a limiting flange.

9. A flexible container, comprising a shell assembly, a cover assembly, and a connection mechanism, wherein the shell assembly forms a detachable connection with the cover assembly through the connection mechanism; and the shell assembly comprises a flexible shell with an opening; and the flexible shell is provided with a limiting step; and the connection mechanism comprises a connecting ring and a compression ring; and the compression ring comprises a limiting member;

the limiting step and the limiting member are configured to be used in conjunction to secure the connecting ring to the flexible shell; and the connecting ring is located inside the opening of the flexible shell;

the compression ring further comprises an insertion part; and the insertion part is located outside the opening of the flexible shell, and the limiting member is partially located inside the opening.

10. The flexible container according to claim 9, wherein the connecting ring is provided with a first connecting part; and the cover assembly is provided with a second connecting part, the second connecting part is detachably connected to the first connecting part, and the limiting member presses against the top of the connecting ring.

11. A flexible container, comprising a shell assembly, a cover assembly, and a connection mechanism, wherein the shell assembly forms a detachable connection with the cover assembly through the connection mechanism;

the shell assembly comprises a flexible shell with an opening;

the flexible shell is provided with a limiting step;

the connection mechanism comprises a connecting ring and a compression ring;

the compression ring comprises a limiting flange;

the limiting step and the limiting flange are configured to be used in conjunction to secure the connecting ring to the flexible shell;

the connecting ring is located inside the opening of the flexible shell;

the compression ring further comprises an insertion part; and the insertion part is located outside the opening of the flexible shell, and the limiting flange is partially located inside the opening.

12. The flexible container according to claim 11, wherein the connecting ring is provided with a first connecting part; and the cover assembly is provided with a second connecting part, the second connecting part is detachably connected to the first connecting part, and the limiting member presses against a top of the connecting ring.

13. The flexible container according to claim 12, wherein the first connecting part and the second connecting part are respectively an external thread and an internal thread provided on the flexible shell and the cover assembly.

* * * * *